US008333147B2

(12) United States Patent
Liao et al.

(10) Patent No.: US 8,333,147 B2
(45) Date of Patent: Dec. 18, 2012

(54) ROLL-TO-ROLL PRINTING APPARATUSES

(75) Inventors: Jane-Hway Liao, Hsinchu County (TW); Yu-Yang Chang, Hsinchu County (TW); Chung-Wen Wu, Hsinchu County (TW); Yi-Ping Lin, Hsinchu County (TW)

(73) Assignee: Industrial Technology Research Institute, Hsinchu (TW)

( * ) Notice: Subject to any disclaimer, the term of this patent is extended or adjusted under 35 U.S.C. 154(b) by 385 days.

(21) Appl. No.: 12/691,611

(22) Filed: Jan. 21, 2010

(65) Prior Publication Data

US 2010/0224087 A1 Sep. 9, 2010

(30) Foreign Application Priority Data

Mar. 9, 2009 (TW) ..... 98107522 A

(51) Int. Cl.
*B05C 17/06* (2006.01)

(52) U.S. Cl. ..... 101/126; 101/123

(58) Field of Classification Search ..... 101/114, 101/123, 124, 126
See application file for complete search history.

(56) References Cited

U.S. PATENT DOCUMENTS 6,367,378 B1 * 4/2002 Yamazaki ..... 101/129
6,422,139 B1 * 7/2002 DeCruz ..... 101/127.1
6,490,970 B2 * 12/2002 Murakami ..... 101/126
6,575,093 B1 * 6/2003 Principe ..... 101/424.1
7,798,062 B2 * 9/2010 Tsunekawa et al. ..... 101/129
7,827,910 B2 * 11/2010 Hilpert et al. ..... 101/129
2004/0079244 A1 * 4/2004 Yamasaki et al. ..... 101/123

FOREIGN PATENT DOCUMENTS

TW M200738077 A 10/2007
TW 200815196 A 4/2008
TW M336646 7/2008

OTHER PUBLICATIONS

Taiwan Patent Office, Office Action, Patent Application Serial No. 098107522, Aug. 24, 2011, Taiwan.

* cited by examiner

*Primary Examiner* — Ren Yan

(57) ABSTRACT

Roll-to-roll printing apparatuses are disclosed. The roll-to-roll printing apparatus includes a printing device with a squeegee moving along a first direction transferring a pattern of a stencil to a roll of working pieces. A sending roller and a receiving roller are disposed on both sides of the printing device. The roll of working pieces is rolled along a second direction to a printing stage of the printing device. An alignment device is disposed corresponding to a position of the stencil and the roll of working pieces. A drying device is disposed on one side of the printing device and may be on the same side with the receiving roller, wherein the drying device cures the patterns on the roll of working pieces.

28 Claims, 5 Drawing Sheets

ROLL-TO-ROLL PRINTING APPARATUSES

CROSS REFERENCE TO RELATED APPLICATIONS

This application is based upon and claims the benefit of priority from a prior Taiwanese Patent Application No. 098107522, filed on Mar. 9, 2009, the entire contents of which are incorporated herein by reference.

BACKGROUND OF THE INVENTION

1. Field of the Invention

The invention relates to roller printing apparatuses, and in particular to a continuous roll-to-roll printing apparatuses.

2. Description of the Related Art

Conventional printing apparatuses can be categorized into sheet-to-sheet printing apparatuses and roll-to-roll printing apparatuses. FIG. 1 is a schematic diagram illustrating a conventional sheet-to-sheet printing apparatus. In FIG. 1, conventional sheet-to-sheet printing is performed by fixing a sheet substrate 15 on a printing stage 10. An alignment device 40 is used to align the sheet substrate 15 to the printing stage 10. The printing stage 10 with the sheet substrate 15 is then moved beneath the printing stencil 20. Paste 25 is transferred onto the sheet substrate 15 using a doctor blade 30 or squeegee. However, for conventional sheet-to-sheet printing, large scale printing cannot be achieved as it is a batch type printing method, wherein a single sheet of substrate is printed one at a time.

On the other hand, for a conventional continuous printing apparatus, skip printing methods are adopted to print a roll of continuous patterns for a planographic printing device. Skip printing methods are performed by sequentially printing $1^{st}$, $3^{rd}$, $5^{th}$ . . . patterns. After the patterns are dried, $2^{nd}$, $4^{th}$, $6^{th}$ . . . patterns are sequentially printed. Typically, the skip printing methods include two categories: one method includes: printing $1^{st}$, $3^{rd}$, $5^{th}$ . . . patterns, drying the patterns, rewinding the roll of working pieces, and printing $2^{nd}$, $4^{th}$, $6^{th}$ . . . patterns; the other method includes serially setting two sets of screen printing apparatuses and drying apparatuses, printing $1^{st}$, $4^{rd}$, $5^{th}$ . . . patterns, drying the patterns, sequentially printing $2^{nd}$, $4^{th}$, $6^{th}$ . . . patterns, and drying the patterns.

FIG. 2A is a schematic arrangement diagram illustrating a conventional roll-to-roll printing apparatus. In FIG. 2A, a roll-to-roll printing apparatus 100 includes a feeding machine 110 sending a flexible substrate roll to a statistic charge removing machine 120 and a first printing machine 130. Odd patterns 1P, 3P, 5P, 7P . . . (2*n*+1)P are printed (shown in FIG. 2B) on the flexible substrate roll and delivered to a UV drying machine 140. The flexible substrate roll is instantly delivered to a second printing machine. Even patterns 2P, 4P, 6P . . . (2*n*)P are printed (shown in FIG. 2B) on the flexible substrate and delivered to a UV drying machine 160. The flexible substrate is wound in a receiving machine 170.

The abovementioned first continuous printing method is advantageous in that apparatus costs and space required for the apparatus is minimal. However, different deformations between each winding process occur due to the flexible substrate being wound twice. Also, misplaced and superimposed patterns may be printed on the substrate due to the difficulty in printing subsequent patterns 2P, 4P, 6P on desired locations called stroke error. For the abovementioned second continuous printing method, it is advantageous in that tensile deformation is prevented due to the odd and even pattern process of the flexible substrate being performed under one tension.

BRIEF SUMMARY OF THE INVENTION

Embodiments of the invention provide a roll-to-roll printing apparatus, comprising: a printing device including a printing stage and a squeegee moving along a first direction, thereby transferring a pattern of a stencil to a roll of working pieces; a sending roller and a receiving roller disposed on both sides of the printing device, wherein the roll of working pieces is rolled along a second direction to the printing stage; an alignment device disposed corresponding to a position of the stencil and the roll of working pieces; and a drying device disposed on one side of the printing device, wherein the drying device cures the pattern on the roll of working pieces.

Embodiments of the invention further provide another roll-to-roll printing apparatus, comprising: a printing device including a printing stage, a frame fixing a stencil, and a squeegee moving along a first direction, thereby transferring a pattern of the stencil to a roll of working pieces; a sending roller and a receiving roller disposed on both sides of the printing device, wherein the roll of working pieces is rolled along a second direction to the printing stage; an alignment device disposed over the printing stage or the frame to align a relative position of the stencil with the roll of working pieces; a drying device disposed on one side of the printing device, wherein the drying device cures the pattern on the roll of working pieces; and a controller device controlling the printing stage moving along an x direction and y direction, or rotating with an angle θ, and controlling the stencil moving along an x direction and y direction, or rotating with an angle θ, thereby regulating alignment relation between the printing stage and the frame.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
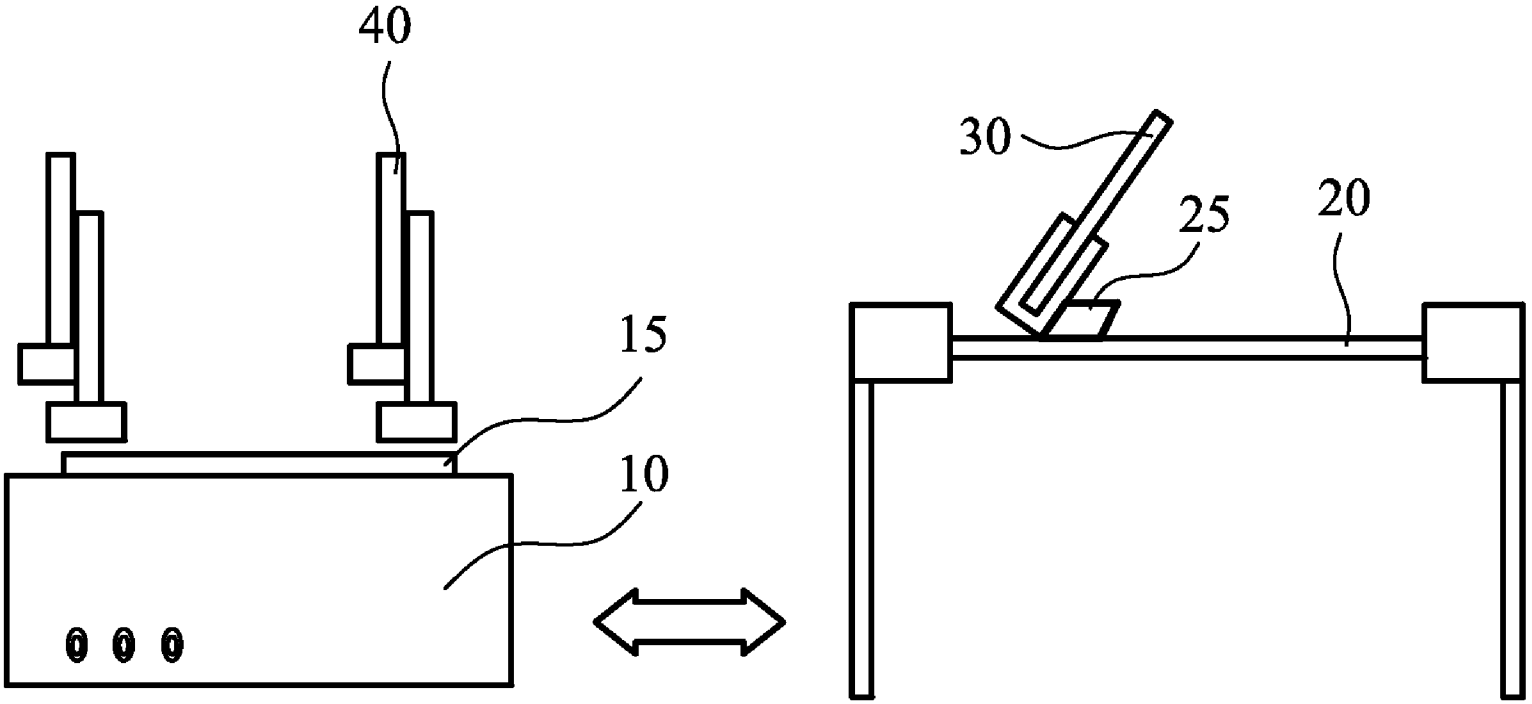
FIG. 1 ( PRIOR ART )
FIG. 1 is a schematic diagram illustrating a conventional sheet-to-sheet printing apparatus.
Figure 2A:
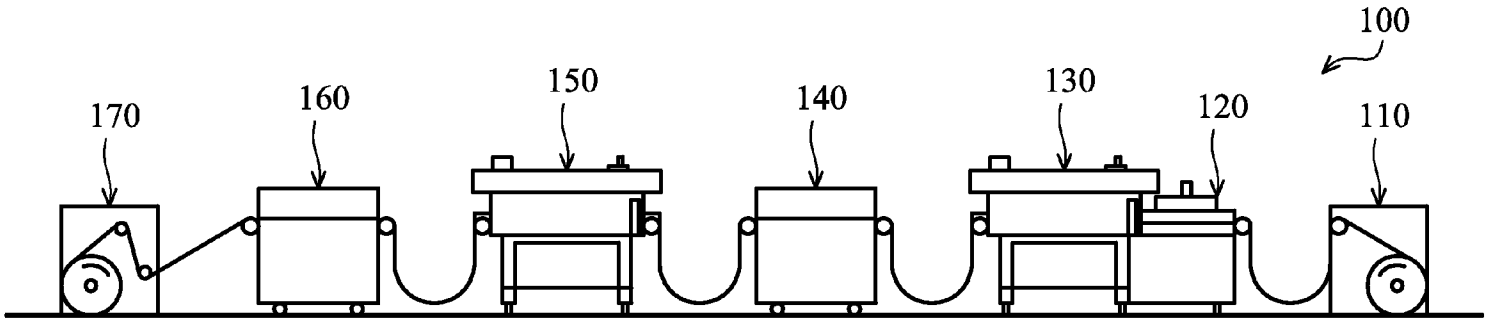
FIG. 2A ( PRIOR ART )
FIG. 2A is a schematic arrangement diagram illustrating a conventional roll-to-roll printing apparatus.
Figure 2B:
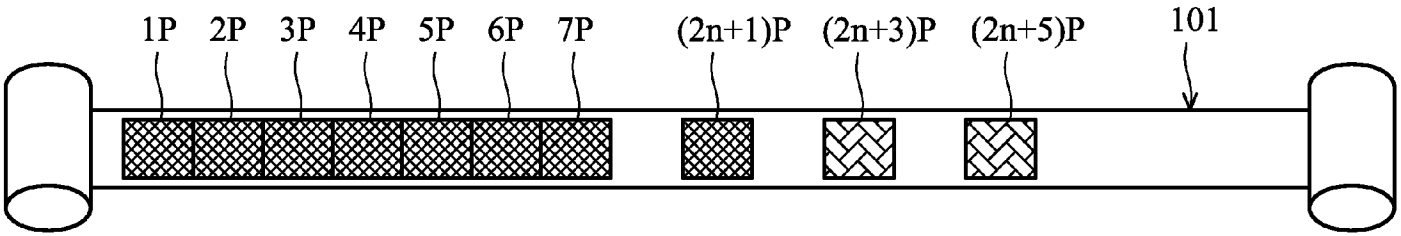
FIG. 2B ( PRIOR ART )
FIG. 2B is a schematic view showing skip printing on a roll of flexible substrate.

It is understood that the following disclosure provides many different embodiments, or examples, for implementing different features of various embodiments. Specific examples of components and arrangements are described below to simplify the present disclosure. These are merely examples and are not intended to be limited. In addition, the present disclosure may repeat reference numerals and/or letters in the various examples. This repetition is for the purpose of simplicity and clarity and does not in itself indicate a relationship between the various embodiments and/or configurations discussed. Moreover, the formation of a first feature over or on a second feature in the description that follows may include embodiments in which the first and second features are formed in direct contact or not in direct contact.

Accordingly, one embodiment of the invention mainly modifies a typical sheet-to-sheet print apparatus into a roll-to-roll printing apparatus with sending and receiving rollers. Therefore, the modified printing apparatus is advantageous not only in that high alignment precision can be achieved as with sheet-to-sheet printing but also continuous patterns can be printed on a long flexible substrate as with roll-to-roll printing. Moreover, space consumption and fabrication costs are dramatically reduced when compared to conventional apparatuses.

Figure 3A:
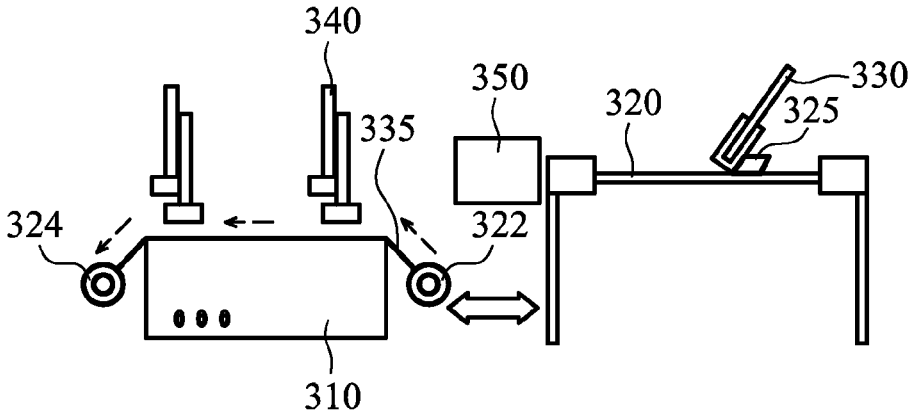
FIGS. 3A-3E are schematic views showing an embodiment of printing steps using a continuous roll-to-roll printing apparatus of the invention.

FIGS. 3A-3E are schematic views showing an embodiment of printing steps using a continuous roll-to-roll printing apparatus of the invention. Referring to FIG. 3A, a sending roller 322 and a receiving roller 324 are disposed on both sides of a printing device in which a roll of working pieces 335 is rolled along a second direction to the printing stage 310. The roll of working pieces 335 includes a flexible substrate, a metal foil, or a composite material film. The printing device comprises a screen printing device, a planographic printing device, a stencil printing device, or a pad printing device.

Subsequently, an alignment device 340 is disposed corresponding to the roll of working pieces 335 and the printing stage 310. The alignment device 340 such as multiple sets of CCD alignment devices is disposed above the printing stage 310 or the stencil. Note that, according to an embodiment of the invention, the multiple sets of CCD alignment devices are independent from movement of the printing stage.

Figure 3B:
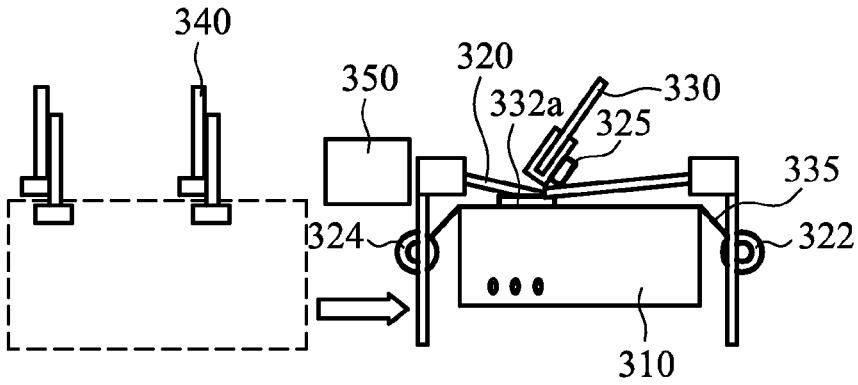

Referring to FIG. 3B, the aligned working pieces 335 and the printing stage 310 are delivered to a printing area and are aligned with a printing stencil 320. The printing stencil 320 is fixed to a frame, and a squeegee 330 move along a first direction, thereby transferring a pattern of the printing stencil 320 to a roll of working pieces 335.

Figure 3C:
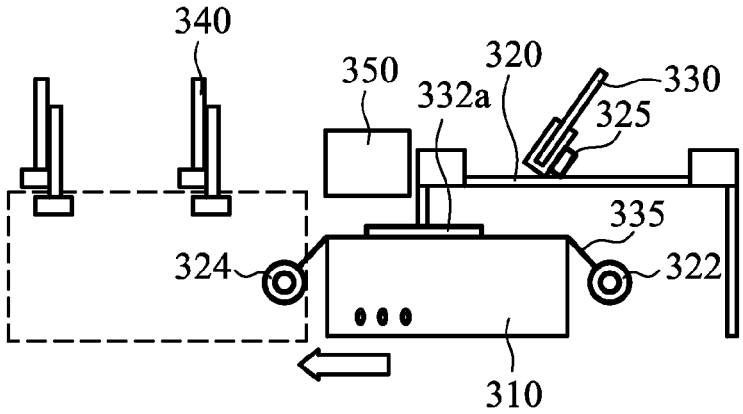

Referring to FIG. 3C, a drying device 350 is disposed on one side of the printing device. The drying device 350 and the receiving roller 324 can be arranged on the same side. The drying device 350 cures the pattern 332*a* on the roll of working pieces 335. For example, the pattern 332*a* on the working pieces 335 is cured by using a UV curing device, heat drying device, or an IR drying device. After the curing process is completed, the printing stage 310 is moved to the alignment area (as shown in the dotted line area).

Figure 3D:
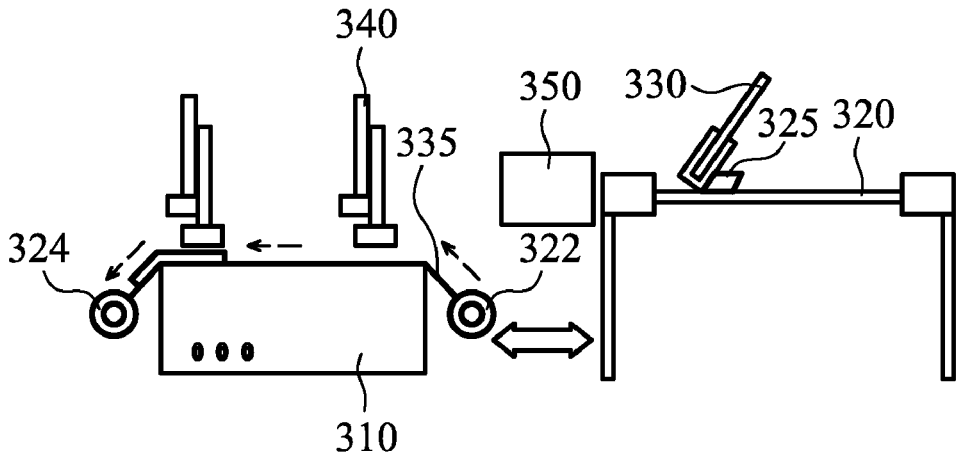
Figure 3E:
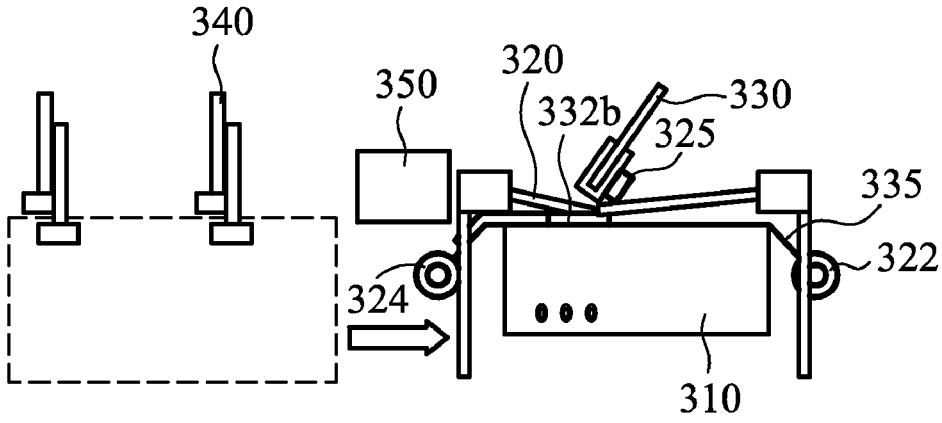

Referring to FIG. 3D, the sending roller 322 and the receiving roller 324 are rolled to wind the working pieces 335 to the next printable region. Subsequently, fabrication processes of FIGS. 3A-3C are repeated to complete the printing processes of subsequent patterns, as shown in FIG. 3E.

Figure 4:
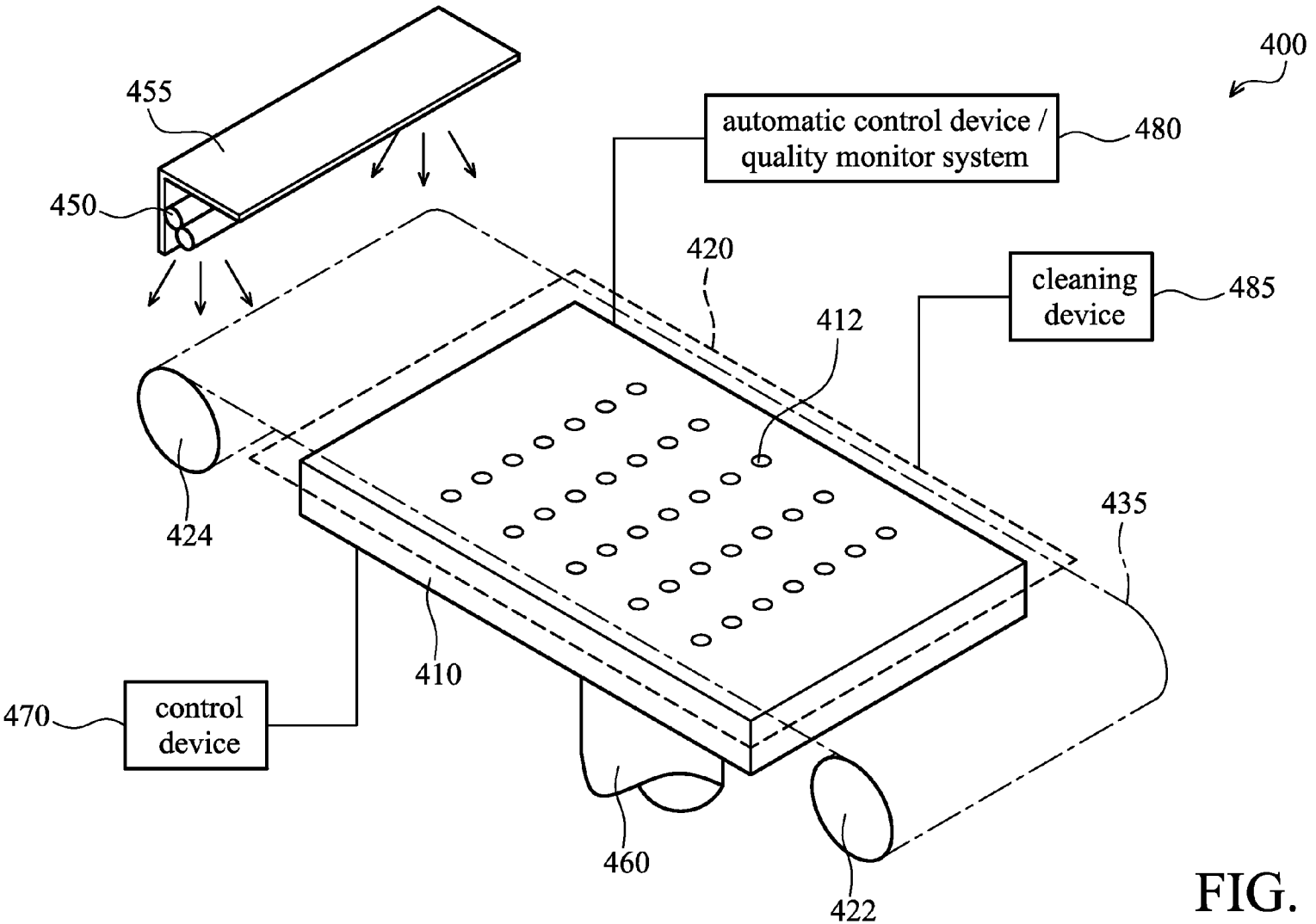
FIG. 4 is a schematic view showing another embodiment of a continuous roll-to-roll printing apparatus of the invention.

FIG. 4 is a schematic view showing another embodiment of a continuous roll-to-roll printing apparatus of the invention. In FIG. 4, a roll-to-roll printing apparatus 400 comprises a printing device including a printing stage 410, a frame fixing a stencil 420, and a squeegee moving along a first direction, thereby transferring a pattern of the stencil 420 to a roll of working pieces 435.

A sending roller 422 and a receiving roller 424 are respectively disposed on both sides of the printing device. The roll of working pieces 435 is rolled along a second direction to the printing stage 410, wherein the first direction is perpendicular to or parallel to the second direction.

An alignment device 422 (such as multiple sets of CCD alignment devices) disposed above the printing stage or the stencil is aligned to a corresponding position of the stencil and the roll of working pieces, as shown in FIG. 3A.

A drying device 450 is disposed on one side of the printing device, wherein the drying device cures the pattern on the roll of working pieces. The drying device and the receiving roller can be arranged on the same side. The drying device comprises a UV curing device, heat drying device, or an IR drying device. Alternatively, the UV curing device comprises an anti-scattering shadow mask 455 preventing paste on the stencil cured. In another embodiment, the roll-to-roll printing apparatus 400 further comprises a cleaning device 485 real-time cleaning the stencil 420, or further comprises a quality monitoring system 480 measuring thickness, line width, or further comprises line interval, or electrical properties of patterns on the roll of working pieces, or further comprises a heat dissipation device 480 cooling temperature of the roll of working pieces, or further comprises a vacuum chuck 412 in the printing staged 410 holding the roll of working pieces, thereby reducing tension of the roll of working pieces.

A controller device 470 controls the printing stage moving along an x direction and y direction, or rotating with an angle θ, and controls the stencil moving along an x direction and y direction, or rotating with an angle θ, thereby regulating alignment relation between the printing stage and the frame. Alignment precision is thus improved to within ±5 μm. In another embodiment, the roll-to-roll printing apparatus further comprises an auto-control device controlling motions of the sending roller, the receiving roller, and the printing device.

Embodiments of the invention provide roll-to-roll printing apparatuses which can be applied to electronic related products, such as electronic paper, solar devices, display devices, radio frequency identification (RFID) devices, and multilayer ceramic capacitor (MLCC) devices, and fabrication processes, such as surface mount technology (SMT).

While the invention has been described by way of example and in terms of the embodiments, it is to be understood that the invention is not limited to the disclosed embodiments. To the contrary, it is intended to cover various modifications and similar arrangements (as would be apparent to those skilled in the art). Therefore, the scope of the appended claims should be accorded to the broadest interpretation so as to encompass all such modifications and similar arrangements.

What is claimed is:

1. A roll-to-roll printing apparatus, comprising:

a printing device comprising a printing stage and a squeegee, wherein the squeegee is moved along a first direction, thereby transferring a pattern of a stencil to a roll of working pieces;

a sending roller and a receiving roller respectively disposed on two opposite sides of the printing stage, wherein the roll of working pieces is rolled from the sending roller to the receiving roller and rolled along a second direction to the printing stage;

an alignment device disposed corresponding to a position of the stencil and the roll of working pieces;

a drying device disposed on one side of the printing device, wherein the drying device cures the pattern on the roll of working pieces; and a controller device controlling the printing stage to move along an x direction and y direction, or rotate with an angle θ, wherein the sending roller and the receiving roller are moved with the printing stage.

2. The roll-to-roll printing apparatus as claimed in claim 1, wherein the roll of working pieces includes a flexible substrate, a metal foil, or a composite material film.

3. The roll-to-roll printing apparatus as claimed in claim 1, wherein the printing device comprises a screen printing device or a stencil printing device.

4. The roll-to-roll printing apparatus as claimed in claim 1, wherein the alignment device comprises multiple sets of CCD alignment devices disposed above the printing stage or the stencil.

5. The roll-to-roll printing apparatus as claimed in claim 1, wherein the alignment device is independent from movement of the printing stage.

6. The roll-to-roll printing apparatus as claimed in claim 4, wherein the controller device controls the stencil to move along an x direction and y direction, or rotate with an angle θ, thereby regulating alignment relation between the printing stage and the stencil.

7. The roll-to-roll printing apparatus as claimed in claim 1, wherein the drying device comprises a UV curing device, heat drying device, or an IR drying device.

8. The roll-to-roll printing apparatus as claimed in claim 7, wherein the UV curing device comprises an anti-scattering shadow mask preventing paste from being cured on the stencil.

9. The roll-to-roll printing apparatus as claimed in claim 1, further comprising a cleaning device real-time cleaning the stencil.

10. The roll-to-roll printing apparatus as claimed in claim 1, further comprising an auto-control device controlling motions of the sending roller, the receiving roller, and the printing device.

11. The roll-to-roll printing apparatus as claimed in claim 1, further comprising a quality monitoring system measuring thickness, line width, line interval, or electrical properties of patterns on the roll of working pieces.

12. The roll-to-roll printing apparatus as claimed in claim 1, further comprising a heat dissipation device cooling temperature of the roll of working pieces.

13. The roll-to-roll printing apparatus as claimed in claim 1, wherein the printing stage comprises a vacuum chuck holding the roll of working pieces, thereby reducing tension of the roll of working pieces.

14. The roll-to-roll printing apparatus as claimed in claim 1, wherein the drying device and the receiving roller are arranged on the same side.

15. A roll-to-roll printing apparatus, comprising:

a printing device comprising a printing stage, a frame fixing a stencil, and a squeegee, wherein the squeegee is moved along a first direction, thereby transferring a pattern of the stencil to a roll of working pieces;

a sending roller and a receiving roller respectively disposed on two opposite sides of the printing stage, wherein the roll of working pieces is rolled from the sending roller to the receiving roller and rolled along a second direction to the printing stage;

an alignment device disposed over the printing stage or the frame to align a relative position of the stencil with the roll of working pieces;

a drying device disposed on one side of the printing device, wherein the drying device cures the pattern on the roll of working pieces; and a controller device controlling the printing stage to move along an x direction and y direction, or rotate with an angle θ, and controlling the stencil to move along an x direction and y direction, or rotate with an angle θ, thereby regulating alignment relation between the printing stage and the frame, wherein the sending roller and the receiving roller are moved with the printing stage.

16. The roll-to-roll printing apparatus as claimed in claim 15, wherein the roll of working pieces includes a flexible substrate, a metal foil, or a composite material film.

17. The roll-to-roll printing apparatus as claimed in claim 15, wherein the printing device comprises a screen printing device or a stencil printing device.

18. The roll-to-roll printing apparatus as claimed in claim 15, wherein the alignment device is independent from movement of the printing stage.

19. The roll-to-roll printing apparatus as claimed in claim 15, wherein the drying device comprises a UV curing device, heat drying device, or an IR drying device.

20. The roll-to-roll printing apparatus as claimed in claim 19, wherein the UV curing device comprises an anti-scattering shadow mask preventing paste on the stencil cured.

21. The roll-to-roll printing apparatus as claimed in claim 15, further comprising a cleaning device real-time cleaning the stencil.

22. The roll-to-roll printing apparatus as claimed in claim 15, further comprising an auto-control device controlling motions of the sending roller, the receiving roller, and the printing device.

23. The roll-to-roll printing apparatus as claimed in claim 15, further comprising a quality monitoring system measuring thickness, line width, line interval, or electrical properties of patterns on the roll of working pieces.

24. The roll-to-roll printing apparatus as claimed in claim 15, further comprising a heat dissipation device cooling temperature of the roll of working pieces.

25. The roll-to-roll printing apparatus as claimed in claim 15, wherein the printing stage comprises a vacuum chuck holding the roll of working pieces, thereby reducing tension of the roll of working pieces.

26. The roll-to-roll printing apparatus as claimed in claim 15, wherein the first direction is perpendicular to or parallel to the second direction.

27. The roll-to-roll printing apparatus as claimed in claim 15, wherein the alignment device comprises multiple sets of CCD alignment devices disposed above the printing stage or the stencil.

28. The roll-to-roll printing apparatus as claimed in claim 15, wherein the drying device and the receiving roller are arranged on the same side.

* * * * *